US009951634B2

(12) United States Patent
Roy Thill et al.

(10) Patent No.: US 9,951,634 B2
(45) Date of Patent: Apr. 24, 2018

(54) ATTACHMENT ARRANGEMENT FOR TURBINE ENGINE COMPONENT

(71) Applicant: United Technologies Corporation, Hartford, CT (US)

(72) Inventors: Carson A. Roy Thill, South Berwick, ME (US); Russell E. Keene, Arundel, ME (US); Paul M. Lutjen, Kennebunkport, ME (US)

(73) Assignee: United Technologies Corporation, Farmington, CT (US)

( * ) Notice: Subject to any disclaimer, the term of this patent is extended or adjusted under 35 U.S.C. 154(b) by 334 days.

(21) Appl. No.: 14/736,333

(22) Filed: Jun. 11, 2015

(65) Prior Publication Data

US 2016/0362992 A1 Dec. 15, 2016

(51) Int. Cl.

| | |
|---|---|
| ***F01D 11/00*** | (2006.01) |
| ***F01D 9/02*** | (2006.01) |
| ***F01D 5/14*** | (2006.01) |
| *F01D 9/04* | (2006.01) |
| *F01D 25/24* | (2006.01) |

(52) U.S. Cl.

CPC ..... *F01D 9/02* (2013.01); *F01D 5/14* (2013.01); *F01D 11/003* (2013.01); *F01D 11/005* (2013.01); *F01D 9/04* (2013.01); *F01D 25/246* (2013.01)

(58) Field of Classification Search

CPC .... F01D 11/003; F01D 11/005; F01D 25/246; F01D 9/04; F01D 5/14; F01D 9/02

See application file for complete search history.

(56) References Cited

U.S. PATENT DOCUMENTS

| | | | | |
|---|---|---|---|---|
| 7,033,138 | B2 | 4/2006 | Tomita et al. | |
| 8,439,629 | B2 * | 5/2013 | Pietraszkiewicz | F01D 11/08 415/116 |
| 8,596,962 | B1 * | 12/2013 | Liang | F01D 11/08 415/116 |
| 2004/0047725 | A1 * | 3/2004 | Tomita | F01D 11/005 415/116 |

(Continued)

FOREIGN PATENT DOCUMENTS

| | | |
|---|---|---|
| EP | 1965031 | 9/2008 |
| WO | 20140138320 | 9/2014 |

(Continued)

OTHER PUBLICATIONS

European Search Report for European Patent Application No. 16173337 competed Oct. 19, 2016.

*Primary Examiner* — William McCalister

(74) *Attorney, Agent, or Firm* — Carlson, Gaskey & Olds, P.C.

(57) ABSTRACT

A component for a gas turbine engine according to an example of the present disclosure includes, among other things, a body having circumferential sides between a forward face and an aft face, each of the circumferential sides defining a mate face, an attachment member extending from the body, and a transition member adjacent to the body and the attachment member. The transition member and the body define a slot configured to receive a seal member. The transition member is sloped inwardly from one of the circumferential sides. A method of fabricating a gas turbine engine component is also disclosed.

23 Claims, 5 Drawing Sheets

(56) References Cited

U.S. PATENT DOCUMENTS

| | | | | |
|---|---|---|---|---|
| 2009/0092485 | A1* | 4/2009 | Bridges, Jr. | F01D 11/008 415/173.7 |
| 2009/0096174 | A1* | 4/2009 | Spangler | F01D 11/005 277/345 |
| 2011/0044801 | A1 | 2/2011 | Di Paola et al. | |
| 2011/0044804 | A1* | 2/2011 | DiPaola | F01D 9/04 415/173.1 |

FOREIGN PATENT DOCUMENTS

| | | |
|---|---|---|
| WO | 2015021029 | 2/2015 |
| WO | 2015031763 | 3/2015 |

* cited by examiner

ATTACHMENT ARRANGEMENT FOR TURBINE ENGINE COMPONENT

BACKGROUND

This disclosure relates to attachment of a component of a gas turbine engine, and more particularly to an arrangement adjacent to an attachment rail.

A gas turbine engine can include a fan section, a compressor section, a combustor section, and a turbine section. Air entering the compressor section is compressed and delivered into the combustion section where it is mixed with fuel and ignited to generate a high-speed exhaust gas flow. The high-speed exhaust gas flow expands through the turbine section to drive the compressor and the fan section.

Segmented static components couple to an engine static structure via one or more attachments.

SUMMARY

A component for a gas turbine engine according to an example of the present disclosure includes a body having circumferential sides between a forward face and an aft face, each of the circumferential sides defining a mate face, an attachment member extending from the body, and a transition member adjacent to the body and the attachment member. The transition member and the body define a slot configured to receive a seal member. The transition member is sloped inwardly from one of the circumferential sides.

In a further embodiment of any of the forgoing embodiments, the slot extends inwardly from the mate face.

In a further embodiment of any of the forgoing embodiments, a portion of the transition member is cantilevered from the body to bound the slot.

In a further embodiment of any of the forgoing embodiments, the transition member tapers into the body.

In a further embodiment of any of the forgoing embodiments, the transition member and the attachment member define a support recess dimensioned to receive a support member coupled to an engine case.

In a further embodiment of any of the forgoing embodiments, the mate face defines a first reference plane, and the transition member has a radial face extending between the slot and the support recess to define a second reference plane transverse to the first reference plane.

In a further embodiment of any of the forgoing embodiments, the seal member is configured to extend through the first reference plane.

In a further embodiment of any of the forgoing embodiments, the attachment member extends from the first reference plane.

In a further embodiment of any of the forgoing embodiments, the component is one of an airfoil, a panel duct and a blade outer air seal (BOAS).

In a further embodiment of any of the forgoing embodiments, the component is an airfoil including an airfoil section extending from a platform, and the mate face is located along the platform.

A gas turbine engine according to an example of the present disclosure includes a blade, and a vane spaced axially from the blade, and a blade outer air seal spaced radially from the blade. At least one of the blade and the vane includes an airfoil section extending from a platform. At least one of the platform and the blade outer air seal includes a body having a mate face, an attachment member extending radially from the body, and a transition member adjacent to the body and the attachment member. The transition member and the body define a slot configured to receive a seal member. The transition member is sloped away from the mate face.

In a further embodiment of any of the forgoing embodiments, the mate face defines a first reference plane, and transition member includes a radial face extending from the slot to define a second reference plane transverse to the first reference plane.

In a further embodiment of any of the forgoing embodiments, the transition member and the attachment member define a support recess configured to receive a support member coupled to an engine case, and the sloped surface extends between the slot and the support recess.

A method of fabricating a gas turbine engine component according to an example of the present disclosure includes: a) forming a transition member adjacent to an attachment member and adjacent to a body having a mate face; b) removing material from the transition member to define a pocket bounded by a sloped surface; c) removing material inwardly from the sloped surface to define a support recess bounded by the attachment member and the transition member; and d) removing material adjacent to the mate face to define a slot dimensioned to receive a seal member, the sloped surface sloping inwardly from the attachment member.

In a further embodiment of any of the forgoing embodiments, each of steps b) and c) is performed by one of machining, grinding, and electro discharge machining (EDM).

A further embodiment of any of the foregoing embodiments includes removing material having at least one stress crack from the sloped surface at a location adjacent to the slot.

In a further embodiment of any of the forgoing embodiments, the mate face defines a first reference plane, and the sloped surface defines a second reference plane intersecting the body and substantially transverse to the first reference plane.

A further embodiment of any of the foregoing embodiments includes positioning a support member coupled to an engine case within the support recess.

In a further embodiment of any of the forgoing embodiments, step d) includes removing material adjacent to the mate face such that a portion of the transition member is cantilevered from the body.

In a further embodiment of any of the forgoing embodiments, the component is one of an airfoil and a blade outer air seal (BOAS).

Although the different examples have the specific components shown in the illustrations, embodiments of this disclosure are not limited to those particular combinations. It is possible to use some of the components or features from one of the examples in combination with features or components from another one of the examples.

The various features and advantages of this invention will become apparent to those skilled in the art from the following detailed description of an embodiment. The drawings that accompany the detailed description can be briefly described as follows.

DETAILED DESCRIPTION

Figure 1:
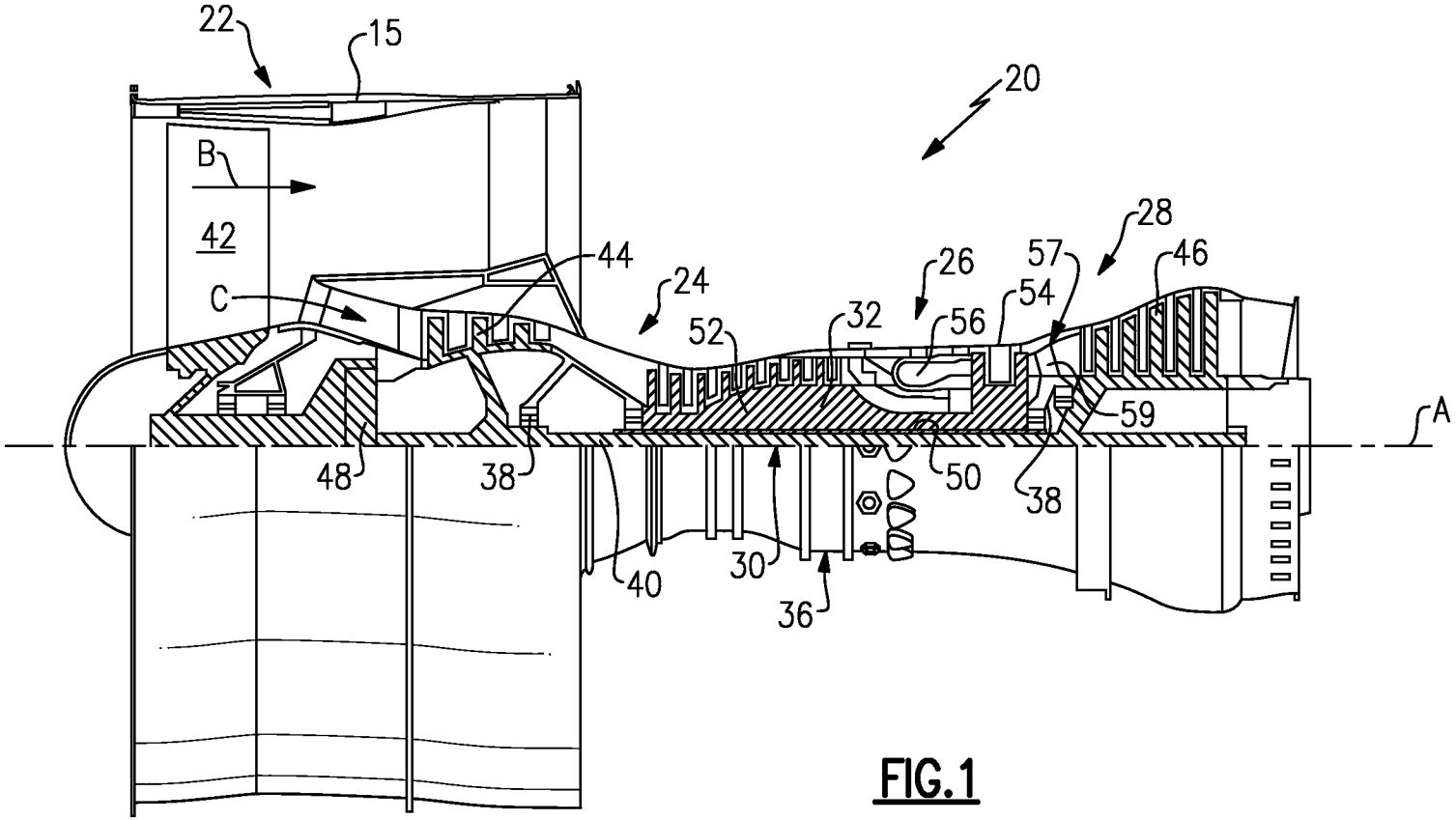
FIG. 1 schematically shows a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmenter section (not shown) among other systems or features. The fan section 22 drives air along a bypass flow path B in a bypass duct defined within a nacelle 15, while the compressor section 24 drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a first (or low) pressure compressor 44 and a second (or low) pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a second (or high) pressure compressor 52 and a first (or high) pressure turbine 54. A combustor 56 is arranged in exemplary gas turbine 20 between the high pressure compressor 52 and the high pressure turbine 54. A mid-turbine frame 57 of the engine static structure 36 is arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five (5:1). Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet. The flight condition of 0.8 Mach and 35,000 ft, with the engine at its best fuel consumption—also known as "bucket cruise Thrust Specific Fuel Consumption ('TSFCT')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram}\ ^\circ\ \text{R})/(518.7^\circ\ \text{R})]^{0.5}$. The "Low corrected fan tip speed" as disclosed herein according to one non-limiting embodiment is less than about 1150 ft/second.

Figure 2:
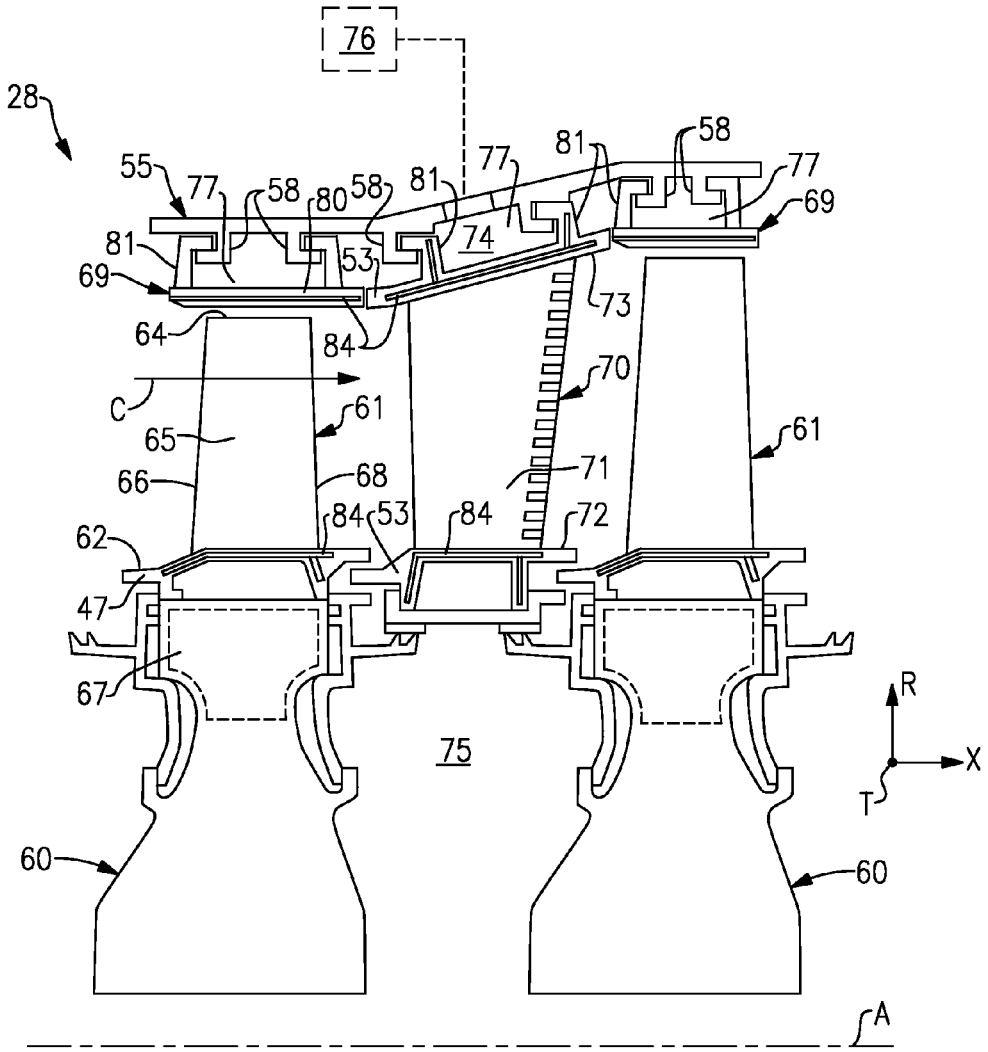
FIG. 2 schematically shows an airfoil arrangement for a turbine section.

FIG. 2 shows selected portions of the turbine section 28, including a rotor 60 carrying one or more airfoils or blades 61 for rotation about the central axis A. In this disclosure, like reference numerals designate like elements where appropriate and reference numerals with the addition of one-hundred or multiples thereof designate modified elements that are understood to incorporate the same features and benefits of the corresponding original elements.

Each blade 61 includes a platform 62 and an airfoil section 65 extending in a radial direction R from the platform 62 to a tip 64. The airfoil section 65 generally extends in a chordwise direction X between a leading edge 66 and a trailing edge 68. A root section 67 (shown in phantom) of the blade 61 is mounted to the rotor 60, for example. It should be understood that the blade 61 can alternatively be integrally formed with the rotor 60, which is sometimes referred to as an integrally bladed rotor (IBR). A blade outer air seal (BOAS) 69 is mounted radially outward from the tip 64 of the airfoil section 65 to bound the core flow path C. A vane 70 is positioned along the engine axis A and adjacent to the blade 61. The vane 70 includes an airfoil section 71 extending between an inner platform 72 and an outer platform 73 to define a portion of the core flow path C. The turbine section 28 includes multiple blades 61, vanes 70, and BOAS 69 arranged circumferentially about the engine axis A.

The BOAS 69 and the vanes 70 are coupled to an engine case 55 of the engine static structure 36 (FIG. 1). The BOAS 69 and/or vanes 70 include one or more attachment rails or members 81 configured to engage a respective support member 58 of the engine case 55, thereby securing the respective BOAS 69 or vanes 70 to the engine static structure 36.

Local cooling cavities 77 of the outer platform 73 of vane 70 and the BOAS 69 define portions of one or more outer cooling cavities 74. The platform 62 of blade 61 and the inner platform 72 of vane 70 define portions of one or more inner cooling cavities 75. The cooling cavities 74, 75 are configured to receive cooling flow from one or more cooling sources 76 to cool portions of the blade 61, BOAS 69 and/or vane 70. Cooling sources 76 can include bleed air from an upstream stage of the compressor section 24 (FIG. 1), bypass air, or a secondary cooling system aboard the aircraft, for example. Each of the cooling cavities 74, 75 can extend in a circumferential or thickness direction T between adjacent blades 61, BOAS 69 and/or vanes 70, for example.

One or more seal members 84, such as one or more feather seals, are arranged between adjacent blades 61, BOAS 69 and/or vanes 70 to reduce flow between the cooling cavities 74, 75 and the core flow path C. Each seal member 84 extends in the circumferential or thickness direction T between mate faces 80 of adjacent BOAS 69, mate faces 47 of adjacent blades 61, or mate faces 53 of adjacent vanes 70, for example.

Figure 3:
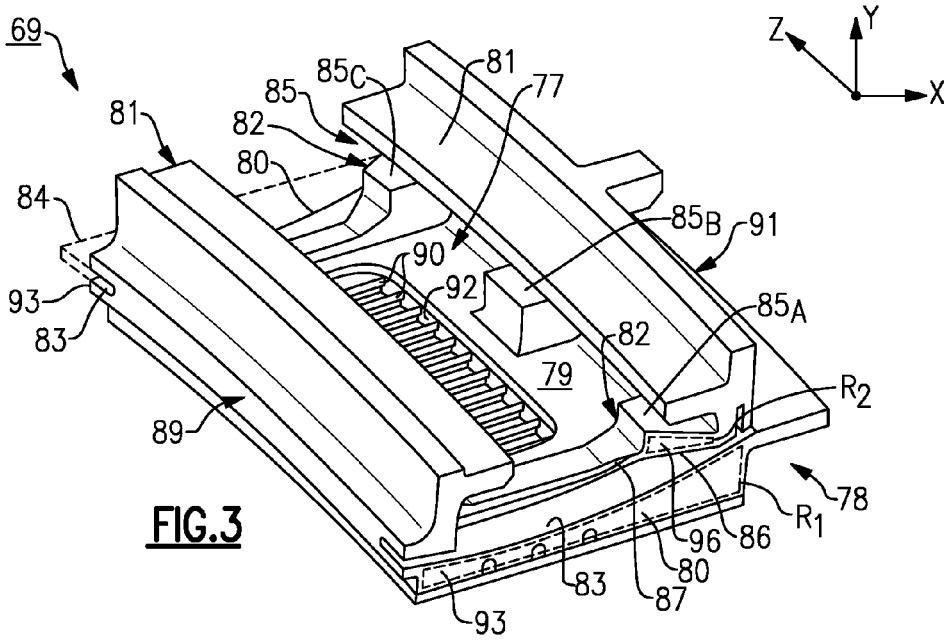
FIG. 3 illustrates a perspective view of a BOAS having an attachment arrangement.

FIG. 3 illustrates an exemplary attachment arrangement 78 for a component of a gas turbine engine. Although the attachment arrangement 78 is discussed herein in the context of the BOAS 69, the teachings herein can be utilized for another portion of the engine 20, such as adjacent to a mate face 47 of blade 61 or a mate face 53 located along one of the platforms 72, 73 of vane 70 of FIG. 2. Other components of the engine 20 can also benefit from the teachings herein, including transition ducts, components of the compressor section 24, and other components subject to thermal gradients and/or pressure loading. In alternative examples, the attachment arrangement 78 of FIG. 3 depicts a portion of a panel duct bounding a portion of the core flow path C (FIGS. 1 and 2).

The BOAS 69 includes a body 79 extending between a forward face 89, an aft face 91 and circumferential sides 93. Each of the circumferential sides 93 defines a mate face 80. Each mate face 80 defines a first reference plane $R_1$ extending in an axial direction X which can correspond to the engine axis A (FIG. 1). One or more attachment rails or members 81 (two shown) extend from the body 79 to engage a respective support member 58 coupled to the engine case 55 (FIG. 2). The attachment member 81, such as a hook rail, extends from the body 79 in a direction of the y-axis. The attachment member 81 extends in a direction of the z-axis from the first reference plane $R_1$ of at least one of the mate faces 80. In alternative examples, the attachment member 81 is spaced apart from the first reference plane $R_1$. Although attachment member 81 is depicted in the context of a hook rail, other arrangements for coupling the attachment member 81 to the engine static structure 36 can be utilized with the teachings herein, such as one or more bolt holes defined in the attachment member 81 to receive fasteners, an engagement surface for a snap ring and the like.

The BOAS 69 includes a transition member 82 adjacent to the body 79 and to one of the attachment members 81. The transition member 82 and the body 79 define portions of a slot 83. The slot 83 extends inwardly from the mate face 80 towards a sidewall 94 and is configured to receive a seal member 84 (shown in phantom). The sidewall 94 can be flat or can have one or more contours 95 blending into adjacent surfaces of the body 79. In the illustrated example, the seal member 84 is a feather seal configured to extend through the reference plane $R_1$ when positioned in the slot 83 such that a portion of the seal member 84 is received in an adjacent slot 83 of an adjacent BOAS 69. In this arrangement, the seal member 84 separates a local cooling cavity 77 of the BOAS 69 from the core flow path C.

The attachment member 81 and the transition member 82 define portions of a support recess 85 dimensioned to receive one of the support members 58 (FIG. 2). The support recess 85 extends in a direction of the z-axis between circumferential sides 93 of the BOAS 69. In the illustrated example, the support recess 85 includes three distinct recessed portions $\mathbf{85}_A$, $\mathbf{85}_B$, $\mathbf{85}_C$ between the mate faces 80.

The transition member 82 has a sloped surface 86 extending radially or in a direction of the y-axis between the slot 83 and the support recess 85. In the illustrated example, the sloped surface 86 is sloped inwardly from the circumferential side 93 and is sloped away from the mate face 80 in the circumferential or z-direction. The sloped surface 86 is sloped in the circumferential or z-direction towards the sidewall 94 of the slot 83. In the illustrated example, the sloped surface 86 includes a radial face 96 defining a second reference plane $R_2$ that intersects the body 79 and is transverse to the first reference plane $R_1$ defined along the mate face 80. The sloped surface 86 is arranged such that a portion of the transition member 82 is cantilevered from the body 79 to bound the slot 83. The arrangement of the sloped surface 86 reduces a mass of the transition member 82, thereby reducing a thermal gradient of the transition member 82 during operation of the engine 20. A reduction in the thermal gradient causes a reduction in stress concentration adjacent the transition member 82. Although the sloped surface 86 is shown having a radial face 96 with a generally planar geometry, other geometries can be utilized for the sloped surface 86. For example, the sloped surface 86 can have a curvilinear geometry having a generally increasing and/or decreasing slope in the circumferential or z-direction. The sloped surface 86 can include one or more contoured surface portions 97 blending into surfaces 98 of the attachment member 81 with other portions of the sloped surface 86 extending inwardly from the surfaces 97 of the attachment member 81 towards the sidewall 94 of the slot 83, as illustrated in FIG. 4D.

In the illustrated example, the sloped surface 86 of the transition member 82 includes a tapered portion 87 configured to taper the sloped surface 86 into surfaces of the body 79, such as one or more contours 95 of sidewall 94. The tapered portion 87 defines a thickness $D_1$ that is less than a maximum thickness $D_2$ of the sloped surface 86 radially or in direction of the y-axis (FIG. 4D). The arrangement of the sloped surface 86 increases the thickness $D_1$ at the tapered portion 87, thereby reducing thermal and mechanical stress concentration in surrounding portions of the transition member 82. The geometry of the sloped surface 86 and the tapered portion 87 also provides for a relatively gradual transition with the body 79 to reduce stress concentration.

Figure 4A:
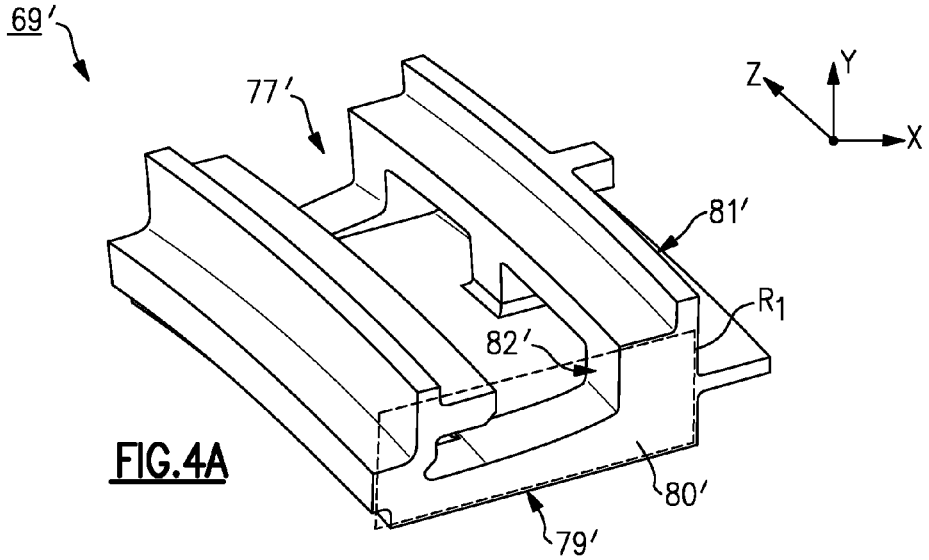
FIG. 4A illustrates a perspective view of a work-piece for a component of a gas turbine engine having an attachment arrangement.
Figure 4B:
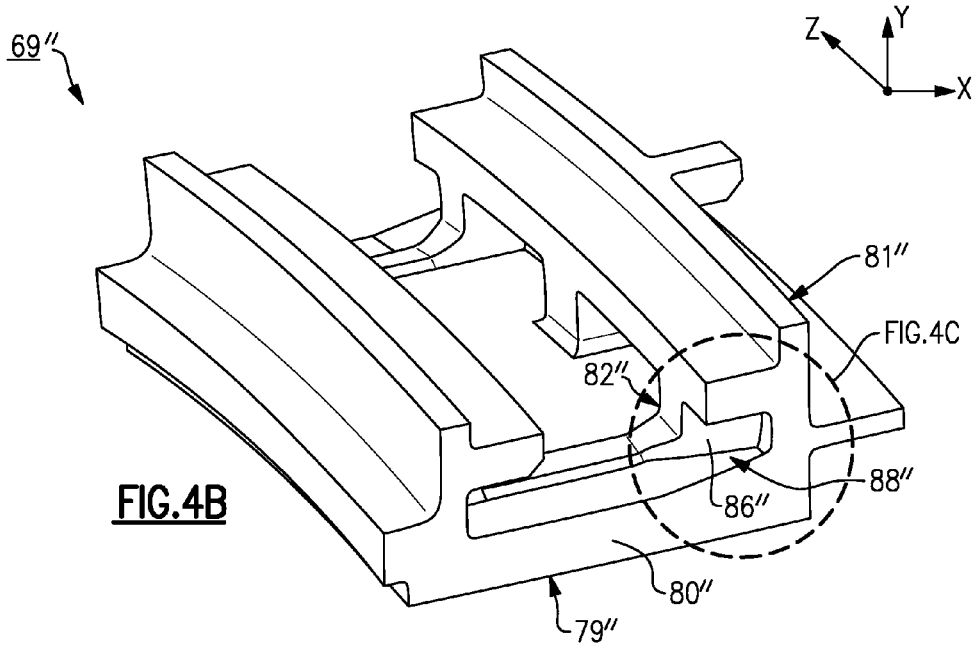
FIG. 4B illustrates a perspective view of the work-piece of FIG. 4A having material removed at selected locations.
Figure 4C:
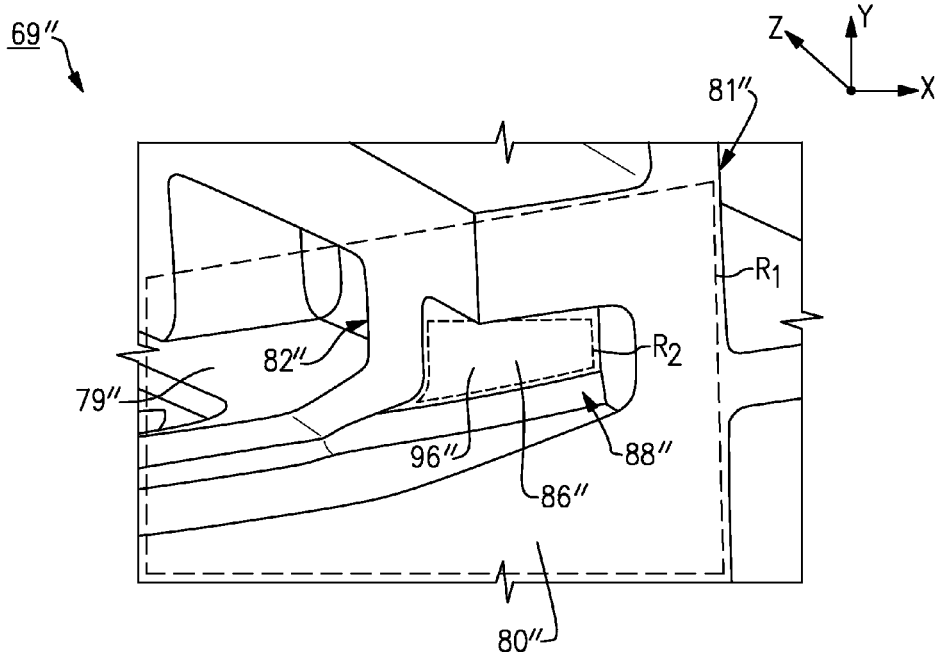
FIG. 4C illustrates a perspective view of selected portions of the work-piece of FIG. 4B.
Figure 4D:
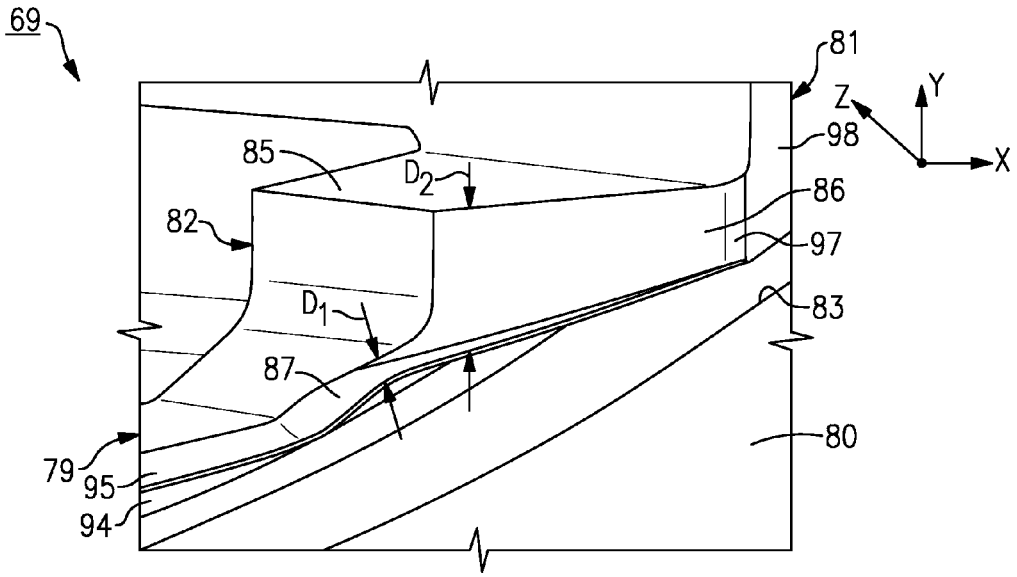
FIG. 4D illustrates a perspective view of selected portions of the work-piece of FIG. 4C having material removed at selected locations.

FIGS. 4A-4D illustrate a method of fabricating a gas turbine engine component, such as the BOAS 69 of FIG. 3. Referring to FIG. 4A, a work-piece 69' of a BOAS is shown. The work-piece 69' includes a body 79' extending from a mate face 80' and an attachment member 81'.

Referring to FIGS. 4B and 4C, material is removed from the work-piece 69' of FIG. 4B inwardly, or otherwise adjacent to, mate face 80" to define a pocket 88". The pocket 88" is bounded by a sloped surface 86". In the illustrated example, the sloped surface 86" includes a radial face 96" which defines a second reference plane $R_2$ that is transverse to a first reference plane $R_1$ of the mate face 80". The pocket 88" is bounded circumferentially or in a direction of the z-axis by the transition member 82", and is bounded radially or in a direction of the y-axis by the attachment member 81" and the body 79". In the illustrated example, the pocket 88" is open to, or otherwise defines, a portion of the local cooling cavity 77. The pocket 88" can have various geometries and orientations depending on the needs of a particular situation and the teachings herein.

Referring to FIG. 4D, material is removed inwardly from a sloped surface 86" of the pocket 88" (FIGS. 4B and 4C) to define the support recess 85 bounded by the attachment member 81 and the transition member 82. Material is removed adjacent to the mate face 80 to define the slot 83 dimensioned to receive the seal member 84 (FIG. 3). In the illustrated example, material is removed adjacent to the mate face 80 such that a portion of the transition member 82 defining the sloped surface 86 is cantilevered from the body 79 and over the slot 83. The seal member 84 can be positioned within the slot 83 once the slot 83 is formed. In some examples, material is removed from the sloped surface 86 to define the support recess 85 prior to removing material adjacent to the mate face 80 to define the slot 83. In alternative examples, material is removed to define the slot 83 prior to removing material to define the support recess 85. The support member 58 (FIG. 2) can be positioned within the support recess 85 once the support recess 85 is formed.

Figure 5:
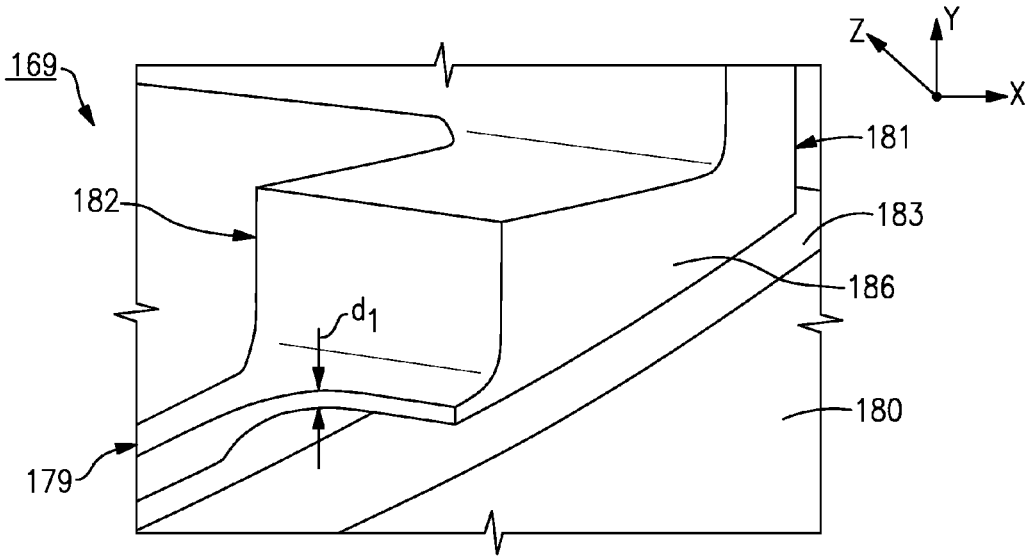
FIG.5 Prior Art
FIG. 5 illustrates a perspective view of selected portions of a component having an attachment arrangement.

The method of fabricating the component illustrated in FIGS. 4A-4D can be performed for the fabrication of an original component, or in the repair of a component, such as blade 61, BOAS 69, or vane 70, utilizing any of the techniques disclosed herein. In some example repairs, material having one or more stress cracks or fissures caused by thermal or mechanical loads, for example, is removed from the transition member 82 at locations adjacent to the sloped surface 86. The geometry of the sloped surface 86 increases the thickness $D_1$ of the transition member 82 at the tapered portion 87 (FIG. 4D), as compared to a thickness $d_1$ of transition member 182 in a prior attachment arrangement 178 for BOAS 169 shown in FIG. 5, and can increase an average thickness of the sloped surface 86 in the radial or y-direction. A relatively greater thickness $D_1$ increases the ability to remove material from, or add material to, the transition member 82 during repair operations. The geometry of the sloped surface 86 also increases the accessibility of deburring tools during repair of the component, for example.

The work-piece 69 can be formed by a casting process, or by a forging process and the like. The material can be removed from work-pieces 69', 69" utilizing a machining, grinding, or electro discharge machining (EDM) process or the like, or can be formed with at least one of the work-pieces 69', 69". The combination of the various techniques of forming the raw component of FIG. 4A and the features of FIGS. 4B to 4D can be utilized to account for a mismatch between the variability of the various techniques to fabricate or repair the component, such as variability in the casting and machining processes.

Although particular step sequences are shown, described, and claimed, it should be understood that steps may be performed in any order, separated or combined unless otherwise indicated and will still benefit from the present disclosure.

It should be understood that relative positional terms such as "forward," "aft," "upper," "lower," "above," "below," and the like are with reference to the normal operational attitude of the vehicle and should not be considered otherwise limiting.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason the appended claims should be studied to determine true scope and content.

What is claimed is:

1. A component for a gas turbine engine, comprising:

a body having circumferential sides between a forward face and an aft face, each of the circumferential sides defining a mate face;

an attachment member extending from the body; and a transition member adjacent to the body and the attachment member, the transition member and the body defining a slot configured to receive a seal member, the transition member having a radial face sloped inwardly from one of the circumferential sides.

2. The component as recited in claim 1, wherein the slot extends inwardly from the mate face.

3. The component as recited in claim 2, wherein a portion of the transition member is cantilevered from the body to bound the slot.

4. The component as recited in claim 3, wherein the transition member tapers into the body.

5. The component as recited in claim 1, wherein the transition member and the attachment member define a support recess dimensioned to receive a support member coupled to an engine case.

6. The component as recited in claim 5, wherein the mate face defines a first reference plane, and the radial face extends between the slot and the support recess to define a second reference plane transverse to the first reference plane.

7. The component as recited in claim 6, wherein the seal member is configured to extend through the first reference plane.

8. The component as recited in claim 6, wherein the attachment member extends from the first reference plane.

9. The component as recited in claim 1, wherein the component is one of an airfoil, a panel duct and a blade outer air seal (BOAS).

10. The component as recited in claim 9, wherein the component is an airfoil including an airfoil section extending from a platform, and the mate face is located along the platform.

11. A gas turbine engine, comprising:

a blade and a vane spaced axially from the blade;

a blade outer air seal spaced radially from the blade; and wherein at least one of the blade and the vane includes an airfoil section extending from a platform, at least one of the platform and the blade outer air seal comprising:

a body having a mate face;

an attachment member extending radially from the body; and a transition member adjacent to the body and the attachment member, the transition member and the body defining a slot configured to receive a seal member, the transition member having a radial face sloped away from the mate face.

12. The gas turbine engine as recited in claim 11, wherein the mate face defines a first reference plane, and the radial face extends from the slot to define a second reference plane transverse to the first reference plane.

13. The gas turbine engine as recited in claim 11, wherein the transition member and the attachment member define a support recess configured to receive a support member coupled to an engine case, and the sloped surface extends between the slot and the support recess.

14. A method of fabricating a gas turbine engine component, comprising:

a) forming a transition member adjacent to an attachment member and adjacent to a body having a mate face;

b) removing material from the transition member to define a pocket bounded by a sloped surface;

c) removing material inwardly from the sloped surface to define a support recess bounded by the attachment member and the transition member; and d) removing material adjacent to the mate face to define a slot dimensioned to receive a seal member, the sloped surface defined by a radial face sloping inwardly from the attachment member.

15. The method as recited in claim 14, wherein each of steps b) and c) is performed by one of machining, grinding, and electro discharge machining (EDM).

16. The method as recited in claim 14, comprising removing material having at least one stress crack from the sloped surface at a location adjacent to the slot.

17. The method as recited in claim 14, wherein the mate face defines a first reference plane, and the sloped surface defines a second reference plane intersecting the body and substantially transverse to the first reference plane.

18. The method as recited in claim 14, comprising positioning a support member coupled to an engine case within the support recess.

19. The method as recited in claim 14, wherein step d) includes removing material adjacent to the mate face such that a portion of the transition member is cantilevered from the body.

20. The method as recited in claim 14, wherein the component is one of an airfoil and a blade outer air seal (BOAS).

21. The component as recited in claim 7, wherein the radial face is distinct from surfaces defining the slot.

22. The component as recited in claim 21, wherein a projection of the second reference plane intersects the forward face.

23. The method as recited in claim 17, wherein the body has circumferential sides between a forward face and an aft face, one of the circumferential sides defining the mate face, the radial face slopes towards a sidewall of the slot, the sidewall spaced apart from the mate face, a projection of the second reference plane intersects the forward face, and the radial face is distinct from surfaces defining the slot.

* * * * *